United States Patent [19]

Wolf

[11] Patent Number: 4,924,603

[45] Date of Patent: May 15, 1990

[54] DEVICE FOR REMOVING CONDENSATE FROM A STEAM-HEATED DRYING CYLINDER OR SIMILAR BY MEANS OF A ROTATING SYPHON

[75] Inventor: Robert Wolf, Herbrechtingen, Fed. Rep. of Germany

[73] Assignee: J.M. Voith GmbH, Heidenheim, Fed. Rep. of Germany

[21] Appl. No.: 299,005

[22] Filed: Jan. 19, 1989

[30] Foreign Application Priority Data

Jan. 22, 1988 [DE] Fed. Rep. of Germany ..... 3801815

[51] Int. Cl.[5] ..... D06F 58/00

[52] U.S. Cl. ..... 34/125; 34/119; 165/90

[58] Field of Search ..... 34/119, 125, 14, 95, 34/95.3; 165/89, 89 H, 90; 137/183

[56] References Cited

U.S. PATENT DOCUMENTS 977,376 11/1910 Dodge ..... 34/125
2,892,264 6/1959 Armstrong .
2,993,282 7/1961 Daane et al. .
3,034,225 5/1962 Hieronymus .
3,264,754 8/1966 Kutchera .
4,369,586 1/1983 Wedel .
4,384,412 5/1983 Chance et al. .
4,498,249 2/1985 Cooke et al. .
4,516,334 5/1985 Wanke .
4,718,177 1/1988 Haeszner et al. .

FOREIGN PATENT DOCUMENTS 2413271 10/1974 Fed. Rep. of Germany .
3414605 10/1985 Fed. Rep. of Germany .

*Primary Examiner*—Henry A. Bennet
*Assistant Examiner*—John Sollecito
*Attorney, Agent, or Firm*—Jeffers, Hoffman & Niewyk

[57] ABSTRACT

Device for removal of condensate from a revolving steam heated drying cylinder or the like. A condensate standpipe rotates with the drying cylinder and features a suction mouthpiece with a suction opening forming an inlet group with the inside wall of the cylinder shell. There is provided, in the area of the suction mouthpiece, at least one guide device which imparts to the steam/condensate mixture entering the condensate standpipe a rotation about the standpipe axis. This guide device enables a reduction of the amount of steam required for dewatering of a drying cylinder. The device is preferably used in dewatering the drying cylinders of a paper machine.

20 Claims, 3 Drawing Sheets

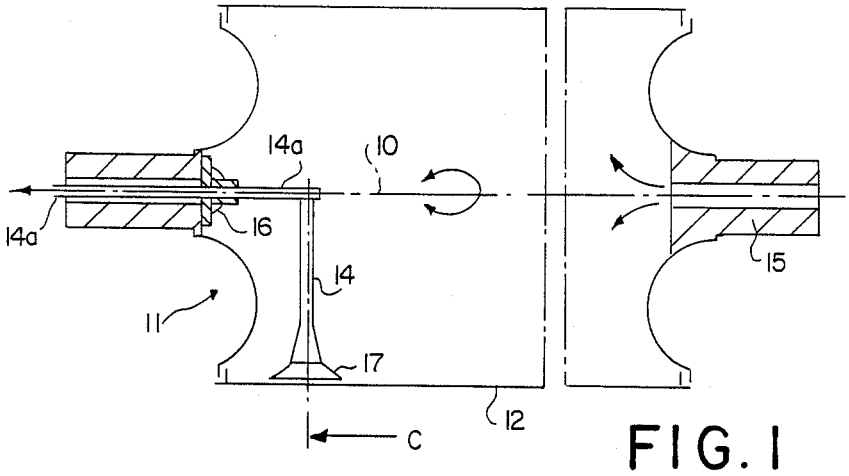
FIG. 1
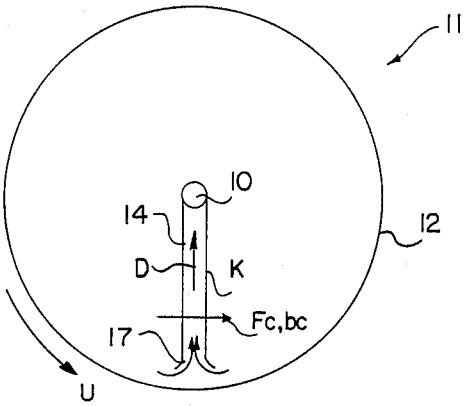
FIG. 2
FIG. 3
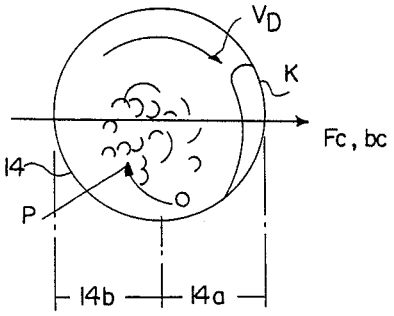

DEVICE FOR REMOVING CONDENSATE FROM A STEAM-HEATED DRYING CYLINDER OR SIMILAR BY MEANS OF A ROTATING SYPHON

BACKGROUND OF THE INVENTION

The present invention concerns a device for removing condensate from a revolving steam-heated drying cylinder or the like. A condensate standpipe rotates with the drying cylinder, communicates outside by way of a substantially coaxial outlet pipe through a journal of the drying cylinder, and extends up to the inner wall of the cylinder shell where it features a suction mouthpiece. A suction opening forms an inlet group with the inner wall of the cylinder shell, and a condensate guide device is contained in the suction mouthpiece. Devices of this type are preferably used in drying cylinders of the drying section of a paper production machine for the drying of a paper web.

Devices of the this type are known as "rotating syphons". Their configurations offer over the so-called "stationary syphon" the advantage that no relative motion takes place between the revolving drying cylinder and the syphon. Thus, the clearance of the inlet gap between the suction mouthpiece and the inside wall of the cylinder can be kept durably consistent and small by means of spaces. As a result, the condensate layer on the inside wall of the drying cylinder becomes permanently thin, resulting in a good heat transfer from the steam to the surface of the drying cylinder under all operating conditions.

Different configurations are known for "rotating syphons", specifically with respect of the suction mouthpiece which is opposite the inside wall of the cylinder shell.

Known from the German Patent Disclosure 35 35 315, corresponding to U.S. Pat. No. 4,718,177, is a rotating syphon where the suction mouthpiece is coordinated with an additional side channel which is fashioned as a steam blow line serving to counteract flooding of the drying cylinder.

Known from U.S. Pat. No. 3,034,225 is a suction mouthpiece in the form of a dish, and from U.S. Pat. No. 2,993,282 one that has the shape of a bell. U.S. Pat. No. 2,892,264 shows a suction mouthpiece with a funnel-shaped suction snout that opens in the orbital direction; the suction mouthpiece itself is attached to the end of a semicircular condensate standpipe whose end supporting the suction mouthpiece extends approximately coaxial with the inside wall of the cylinder shell. Known from U.S. Pat. No. 3,264,754, lastly, is a suction mouthpiece having the shape of a flat nozzle whose slot-shaped inlet opening extends parallel to the direction of rotation and in the inlet area of which there are bevels provided which in the axially parallel direction slant toward the inside wall of the cylinder shell favoring the influx of condensate. An insert of similar effect and having the shape of a partition for reversing the condensate into the interior of the suction mouthpiece is also taught by said U.S. Pat. No. 2,993,282. According to U.S. Pat. No. 4,384,412, the cross section of the partition is wedge-shaped in order to improve said reversal effect.

The objective of these designs is to increase the transport effect of the steam on the condensate and thus the conveying capacity in the condensate standpipe. This transport effect, in principle, is based on the fact that inside the drying cylinder a higher steam pressure is present than in the condensate standpipe including the suction mouthpiece, so that a part of the steam supplied from outside constantly flows outward through the rotating syphon, mixes with the amount of condensate to be conveyed and thus removes it outward.

Based on the specific design of the suction mouthpiece and, as the case may be, on the arrangement of additional steam holes, these prior conceptions or designs have by and large proved and established themselves in practice. It has so far been accepted that the quantities of steam that are required for a dependable dewatering of the cylinder interior are very large, due to the necessary and relatively high differential pressure between cylinder interior and condensate standpipe.

SUMMARY OF THE INVENTION

The problem of required high differential pressure is solved in that in the area of the suction mouthpiece there is at least one guide device provided which imparts to the steam/condensate mixture entering the condensate standpipe a rotation about the standpipe axis.

The point of departure of this solution lies in the insight that a coriolis acceleration toward the one standpipe wall acts on the steam condensate mixture flowing in the condensate standpipe, due to the rotating system. In the prior designs, this results in a demixing of condensate and steam, with the result that a water film rises on the one standpipe wall and that between this water film and the opposite standpipe wall a free space is created through which the steam can freely flow. The dewatering effect is based on the fact that said (one-sided) water film is entrained by surface friction between the condensate and the steam. However, as already mentioned, the steam consumption in the process is relatively large.

To compensate for this negative effect of the coriolis acceleration, the present invention suggests to impart a rotary pulse (spin) to the steam/condensate mixture entering the condensate standpipe. It is to be expected that the amount of condensate carried by the steam that flows through the condensate standpipe will be considerably greater than in the above example, so that an operationally safer dewatering of the drying cylinder is achievable with an amount of steam considerably smaller than heretofore.

Practical embodiments of the guide device of the present invention are described herein. These are based on three specific design examples involving simple inclined baffles, a conic insert with slanted baffles, and a spiral.

The invention will be more fully explained hereafter with the aid of the drawing.

BRIEF DESCRIPTION OF THE DRAWINGS

FIG. 1 shows schematically a drying cylinder of a paper machine in longitudinal section;

FIG. 2 shows a schematic illustration explaining the influence of the coriolis acceleration on the condensate in a condensate standpipe according to the prior art;

FIG. 3 shows a schematic illustration explaining the effect of the guide device on the condensate flowing in the condensate standpipe;

DESCRIPTION OF THE PREFERRED EMBODIMENTS

Figure 5:
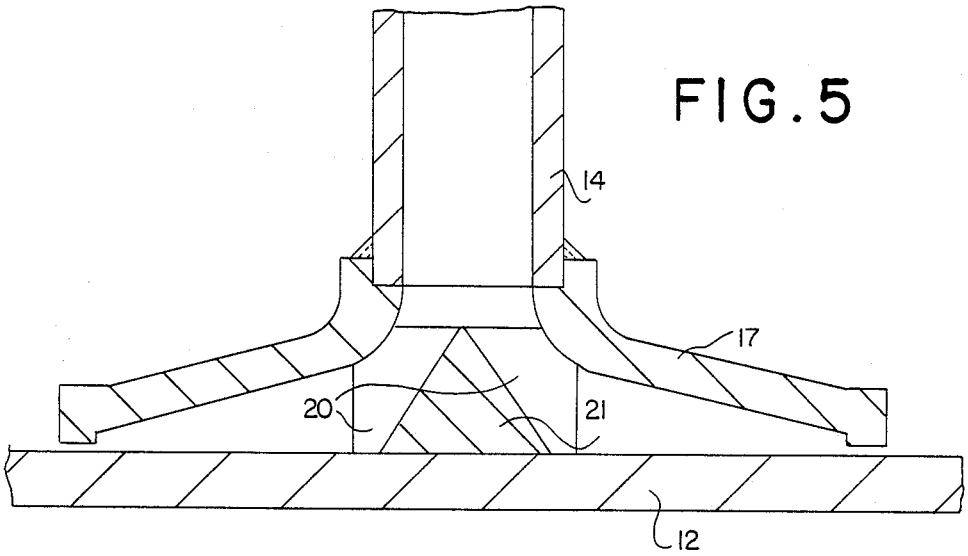
FIG. 5 shows a sectional illustration of a second embodiment of a guide device analogous to section line A—A relative to FIG. 4*b.

Illustrated in FIG. 1 is a drying cylinder which is marked 11 overall and which in customary fashion features a cylinder shell 12 and on each end a cylinder plate with a pertaining hollow journal 13 or 15. The drying cylinder 11 can be heated with steam which is fed through the journal 15 into the interior of the drying cylinder. The condensate forming in the cylinder is removed from the cylinder with the aid of a condensate standpipe 14 and an outlet pipe 14*a* which is coaxial with the axis of rotation 10 of the drying cylinder 11. The condensate standpipe 14 has a longitudinal axis and extends—either straight or curved—approximately in the radial direction from the inside wall of the cylinder shell 12 to the axis of rotation 10 of the cylinder. This coaxial outlet pipe 14*a* is mounted on the journal 13 by means of a bracket 16 and extends outward through the journal. Composed of the condensate standpipe 14 and the outlet pipe 14*a*, the condensate suction pipe is rigidly mounted in the drying cylinder 11 and rotates jointly with it.

In its radially outer end (i.e., near the inside wall of the cylinder shell 12) the condensate standpipe 14 has a suction mouthpiece 17. The latter has the shape of a bell or cap with an intake opening (round or square) facing toward the inside wall of the cylinder shell 12. Provided on the suction mouthpiece 17 may be a suction snout (not illustrated) which opens in the direction of rotation of the drying cylinder or suction mouthpiece 17. The edges of the suction mouthpiece 17 extend at a small distance from the inside surface of the cylinder shell 12 so that a small entrance gap for the condensate and steam is formed between the suction mouthpiece 17 and the cylinder shell 12.

FIG. 2 shows the drying cylinder 11 according to FIG. 1 in a sectional illustration along line C relative to FIG. 1, illustrating the influence of the coriolis acceleration $b_c$ on the steam/condensate mixture in the condensate standpipe 14 of prior designs. The cylinder shell 12 of the drying cylinder 11 rotates together with the condensate pipe 14 about the axis of rotation 10 at a speed of rotation U. This rotating system produces a coriolis acceleration $b_c$ with a direction perpendicular to the longitudinal axis of the condensate standpipe 14 and acting on the steam/condensate mixture entering through the suction mouthpiece 17. Since the condensate particles have a considerably greater mass than the steam particles, the coriolis force $F_c$ acting on each particle is much greater also in the condensate than in the steam. The condensate K is forced in the direction of the coriolis force $F_c$ toward the front area of the standpipe wall relative to the direction of rotation. The steam D entering the condensate standpipe 14 thus flows across the condensate K without entraining it to a sufficient degree.

FIG. 3 shows said flow conditions schematically with the aid of the illustrated cross section of the condensate standpipe 14, such as result from the use of a guide device in accordance with the present invention. As it enters the suction mouthpiece or condensate standpipe 14, the condensate mixture receives on account of the persent guide device a rotary pulse causing its influx in the condensate standpipe 14 to be at a defined spin velocity $V_D$. A demixing of the steam/condensate mixture occurs under the coriolis acceleration $b_c$ and the condensate K collects on the front area 14*a* (relative to the peripheral direction) of the standpipe wall. The condensate K no longer remains there (as before) but flows in the direction toward the rear area 14*b* of the standpipe wall. On its way it is lifted off the wall (arrow P) by the coriolis force $F_c$ and thus entrained more effectively than heretofore because a mixing of steam and condensate occurs again.

Based on theoretical thoughts and assuming that the velocity factors of the flow velocity $V_D$ of the steam in the condensate standpipe 14 and of the spin pulse $V_R$ are perpendicular to each other, a relation of $$V_D \approx 0.27 V_R$$

is deemed suitable.

Figure 4A:
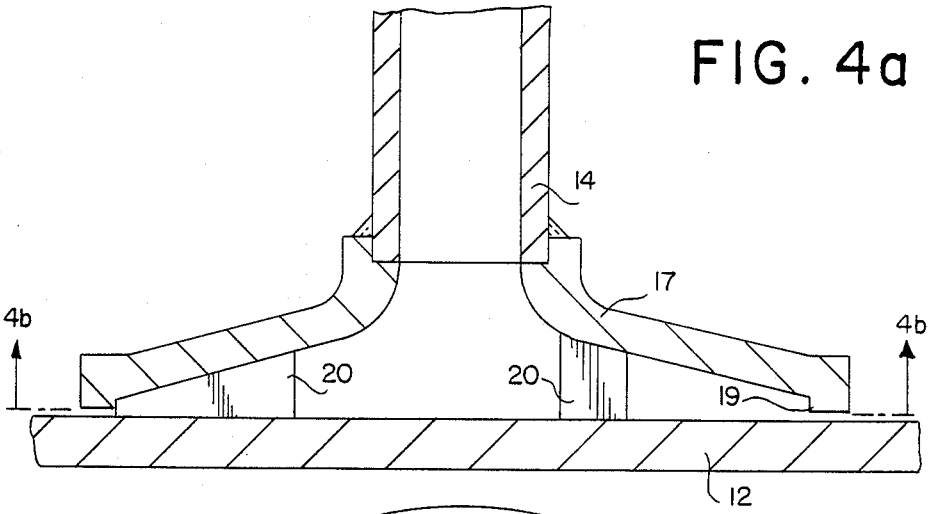
FIG. 4*a* shows a sectional illustration of a first embodiment of a guide device according to section line A—A relative to FIG. 4*b;*
Figure 4B:
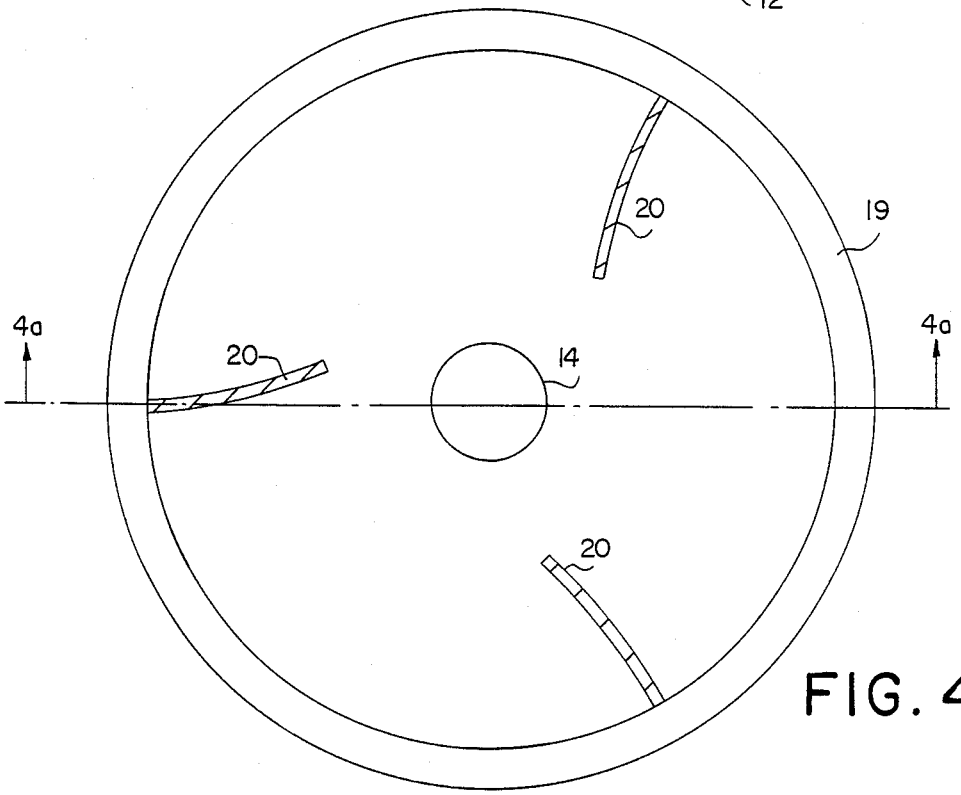
FIG. 4*b* shows a sectional illustration of the embodiment according to FIG. 4*a* according to section line B—B relative to FIG. 4*a;*

FIGS. 4*a* and 4*b* show a first embodiment of the guide device in two sectional illustrations: in FIG. 4*a* along line A—A relative to FIG. 4*b*, and in FIG. 4*b* along line B—B relative to FIG. 4*a*.

Illustrated in FIG. 4*a* is a part of the condensate standpipe 14 with a cap type suction mouthpiece 17 which practically acts as a funnel for the condensate standpipe 14. The suction mouthpiece 17 is permanently connected with the condensate standpipe 14 and has on its rim opposite the cylinder shell 12 a surrounding circular bead 19 which is spaced from the cylinder shell to form an inlet gap. Provided in the area between the cylinder shell 12 and the inside of the mouthpiece 17, and distributed across the circumference, are three baffles 20 which relative to imaginary radial lines are slanted or curved according to FIG. 4*b*. The steam/condensate mixture entering the inlet gap receives thus a specific spin; the steam/condensate mixture flows helically through the condensate standpipe 14. The direction of slant or curvature of the baffles 20 is selective, i.e., a clockwise or counterclockwise spin may be generated. The baffles 20 border on one side on the circular bead 19 and extend up to about one-half the diameter into the interior of the suction mouthpiece 17; on the cylinder shell 12 itself, the baffles 20 may border directly.

FIG. 5 shows another embodiment of the guide device analogous to section line A—A relative to FIG. 4*b*. Condensate standpipe 14, suction mouthpiece 17 and cylinder shell 12 are balanced with one another the same as according to FIG. 4*a*. The guide device itself consists of a body 21 having the shape of a pyramid or truncated cone and which with its larger base is opposite the cylinder shell 12 while featuring, distributed across its cylinder line, a number—(for instance 4)—of baffles 20' which are slanted or curved analogous to the embodiment relative to FIG. 4. The conic body 21 is arranged coaxially relative to the condensate standpipe 14 and borders directly on the cylinder wall 12 with the baffles 20', which are attached flush. Consisting of the conic body 21 and the baffles 20', this insert body is by way of the free corner areas of the baffles 20' connected with the inside wall of the suction mouthpiece 17.

Figure 6:
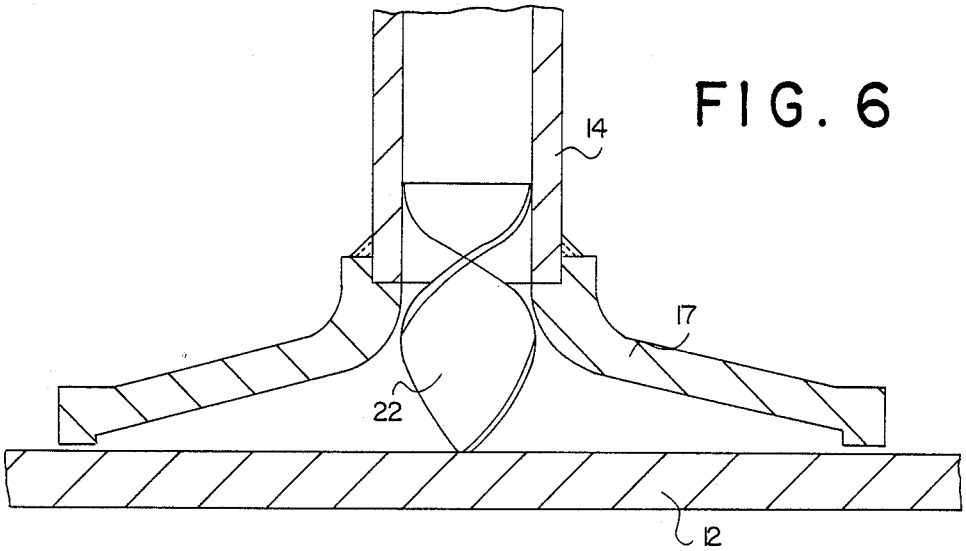
* and FIG. 6 shows a sectional illustration of a third embodiment of a guide device analogous to section line A—A according to FIG. 4*b*.

FIG. 6 shows a third embodiment of the guide device, also analogous to section line A—A relative to FIG. 4*b*. Condensate standpipe 14, suction mouthpiece 17 and cylinder shell 12 are balanced also as in FIG. 4. The guide device consists here of a spiral 22 which is inserted coaxially in the condensate standpipe and fixed. The spiral 22 consists of a flat and axially twisted rectangular shape which with its free end bears on the cylinder shell 12 and may extend across the entire length of the condensate standpipe 14. Obtained with this design on the entrance of the condensate standpipe 14 are two separate flows of the steam/condensate mixture to which a spin is imparted across the entire length of standpipe 14.

What is claimed is:

1. Apparatus for removing condensate from a revolving steam-heated drying cylinder of a paper production machine, said drying cylinder being supported by journals for rotation about an axis of rotation and including a cylinder shell having an inner wall surface, said apparatus comprising:

a condensate standpipe disposed within said drying cylinder, said standpipe arranged to rotate together with the drying cylinder, said standpipe having a longitudinal axis extending substantially radially from the axis of rotation of the cylinder to the inner wall surface of the cylinder shell and having thereat a suction mouthpiece with a suction opening forming an inlet gap with the inner wall of the cylinder shell;

an outlet pipe extending through a journal of the drying cylinder and communicating with said standpipe for passing condensate from said standpipe outside said drying cylinder; and a condensate guide device contained in the suction mouthpiece, said condensate guide device including at least one reversal surface which imparts to steam/condensate mixture entering the condensate standpipe a rotation about the longitudinal axis of the condensate standpipe.

2. Apparatus according to claim 1, in which said condensate guide device includes a plurality of baffles each inclined relative to a radius of said standpipe and arranged at equidistant spacing circumferentially on the suction mouthpiece.

3. Apparatus according to claim 2, in which said baffles are curved.

4. Apparatus according to claim 2, in which said suction mouthpiece is of a cap type having an outer edge and said baffles border on the outer edge.

5. Apparatus according to claim 2, in which the baffles border directly on the inside wall surface of the cylinder shell.

6. Apparatus according to claim 4, in which the baffles border directly on the inside wall of the cylinder shell.

7. Apparatus according to claim 1, in which the condensate guide device includes a conic body arranged coaxially with the condensate standpipe, said conic body having its base disposed adjacent the inside wall of the cylinder shell, and further including a plurality of baffles each inclined relative to a radius of said standpipe and distributed at equidistant spacing circumferentially, said baffles being connected with the suction mouthpiece.

8. Apparatus according to claim 7, in which said baffles are curved.

9. Apparatus according to claim 7, in which the baffles are so dimensioned that they protrude sideways beyond the base of the conic body.

10. Apparatus according to claim 7, in which the baffles and the base of the conic body are flush and border directly on the inside wall surface of the cylinder shell.

11. Apparatus according to claim 8, in which the baffles and the base of the conic body are flush and border directly on the inside wall surface of the cylinder shell.

12. Apparatus according to claim 9, in which the baffles and the base of the conic body are flush and border directly on the inside wall surface of the cylinder shell.

13. Apparatus according to claim 1, in which the condensate guide device includes a spiral arranged coaxially in the suction mouthpiece and protrudes in the condensate standpipe.

14. Apparatus according to claim 13, in which the spiral has the shape of an axially twisted flat rectangle.

15. Apparatus according to claim 13, in which the spiral borders directly on the inside wall surface of the cylinder shell.

16. Apparatus according to claim 14, in which the spiral borders directly on the inside wall surface of the cylinder shell.

17. Apparatus according to claim 13, in which the spiral extends across the entire length of the condensate standpipe.

18. Apparatus according to claim 14, in which the spiral extends across the entire length of the condensate standpipe.

19. Apparatus according to claim 15, in which the spiral extends across the entire length of the condensate standpipe.

20. Apparatus according to claim 16, in which the spiral extends across the entire length of the condensate standpipe.

* * * * *